United States Patent [19]

Pincha

[11] 4,377,057

[45] Mar. 22, 1983

[54] HAND CABBING APPARATUS

[75] Inventor: Philip J. Pincha, Seattle, Wash.

[73] Assignee: Lortone, Inc., Seattle, Wash.

[21] Appl. No.: 149,024

[22] Filed: May 12, 1980

Related U.S. Application Data

[62] Division of Ser. No. 915,477, Jun. 14, 1978, abandoned.

[51] Int. Cl.[3] ..... B24D 17/00

[52] U.S. Cl. ..... 51/359; 51/381; 51/382

[58] Field of Search ..... 51/358, 181 R, 359, 51/360, 361, 362, 363, 391, 229, 262 R, 370, 371, 382, 383, 385, 388, 387, 381

[56] References Cited

U.S. PATENT DOCUMENTS

| | | | |
|---|---|---|---|
| 838,465 | 12/1906 | Seaborn | 51/383 |
| 932,879 | 8/1909 | May | 51/370 |
| 1,175,245 | 3/1916 | Dennis | 51/383 |
| 1,566,164 | 12/1925 | Norton | 51/361 |
| 1,629,980 | 5/1927 | Tietz | 51/382 |
| 2,078,484 | 4/1932 | Dobson | 51/181 UX |
| 2,543,554 | 2/1951 | McClure | 51/391 |
| 2,886,923 | 5/1959 | La France | 51/383 |
| 2,922,177 | 1/1960 | Hudson | 51/382 |
| 2,982,059 | 5/1961 | Trussell | 51/371 |
| 3,225,497 | 12/1965 | Brandt | 51/358 |
| 3,254,630 | 6/1966 | Tufan | 51/181 |
| 3,323,259 | 6/1967 | Stout | 51/229 |
| 3,902,285 | 9/1975 | Lalish | 51/229 |

FOREIGN PATENT DOCUMENTS

| | | | |
|---|---|---|---|
| 260829 | 1/1926 | United Kingdom | 51/385 |

OTHER PUBLICATIONS

Sears Catalog, Spring/Summer, 1975, p. 253, "Rock Tumbling Kit".

*Primary Examiner*—Harold D. Whitehead
*Attorney, Agent, or Firm*—Seed, Berry, Vernon & Baynham

[57] ABSTRACT

Apparatus, including a kit and elements thereof, for manually producing cabochons from various types of rocks and gemstones such as onyx, agate, opal, jade, etc. The kit contains all necessary equipment for hobbyists and craftsman to shape and polish gemstones from preform pieces of rock or stone. Also disclosed are various novel embodiments of base frames and attachment means for fixedly securing abrasive and polishing media to the base frame.

2 Claims, 17 Drawing Figures

112
114
134
136
138
140
142
144
150
152
154
156
158
118

HAND CABBING APPARATUS

This is a division of application Ser. No. 915,477, filed June 14, 1978, and now abandoned.

SUMMARY OF THE INVENTION

This invention relates to the field of lapidary and more particularly to apparatus for use in manual or hand cabbing various types of rock and stone into cabochons of gemstone quality.

An object of the invention is to provide a kit for use in hand cabbing of gemstones and the like, the kit comprising a box frame having an hollow interior portion, a selection of flexible sheet members, means for fastening a selected one of the sheet members to the box frame with a portion of the sheet member being partially disposed within the hollow interior portion, at least one preform stone, at least one dop stick, dop adhesive means for attaching the dop stick to the preform stone, a shaping stone and a supply of polishing material.

Another object of the invention is to provide such a hand cabbing kit wherein the selection of flexible sheet members includes a selection of abrasive sheets and at least one polishing cloth.

A further object of the invention is to provide such a kit wherein the abrasive sheets are abrasive screen material.

A still further and important part of the invention is to provide hand cabbing apparatus comprising a frame including a base and upstanding walls about the periphery of the base, a sheet of coated abrasive material extending over the base, and attaching means for attaching the coated abrasive material to the frame.

Other important objects of the invention will hereinafter appear and the nature of the invention will be more clearly understood by reference to the following detailed description, the appended claimed subject matter, and the several views illustrated in the accompanying drawings.

DETAILED DESCRIPTION OF THE PREFERRED EMBODIMENTS

Figure 1:
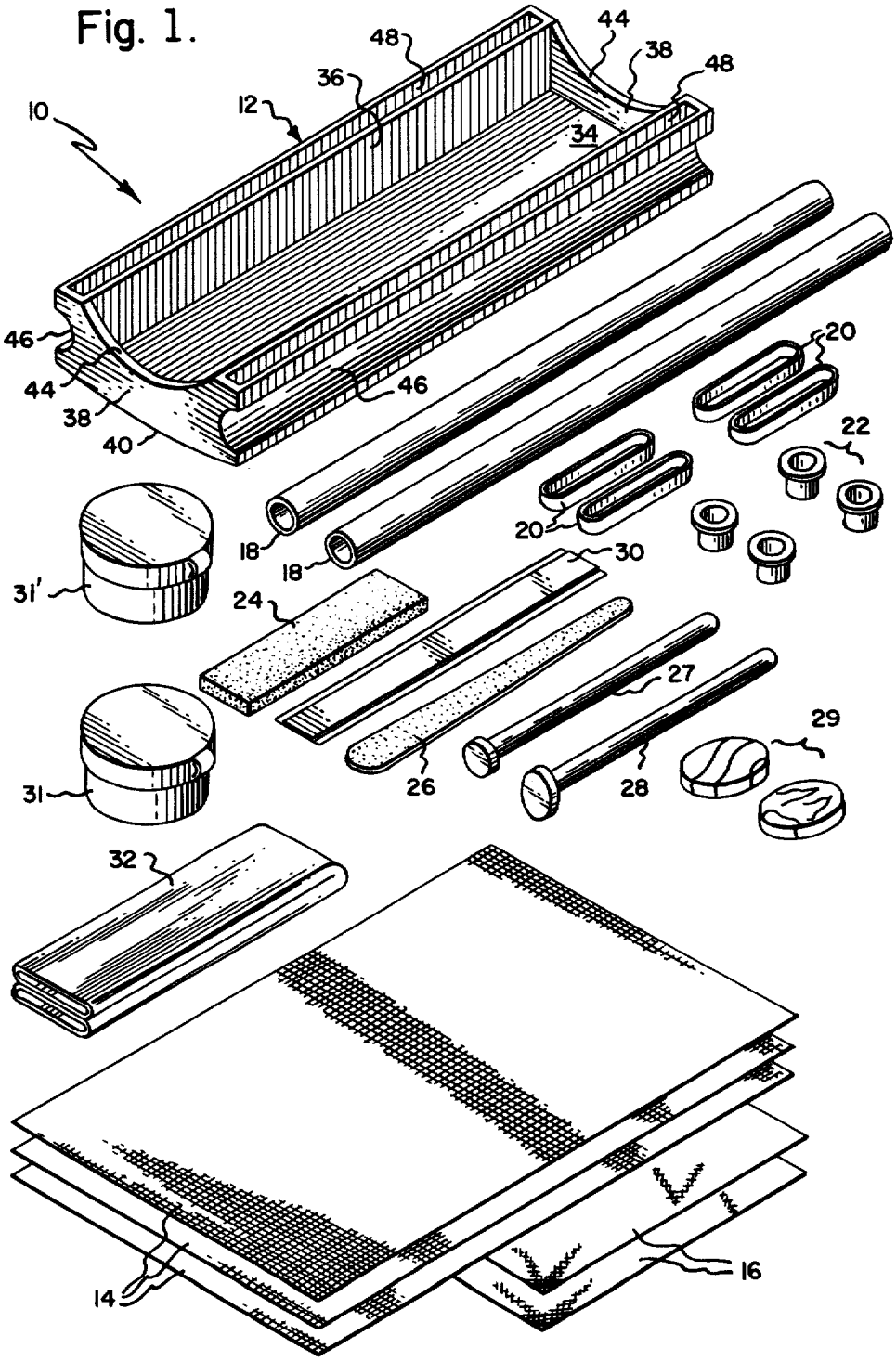
FIG. 1 is a perspective view of apparatus which, taken together, form a kit for use in hand cabbing of gemstones.
Figure 2:
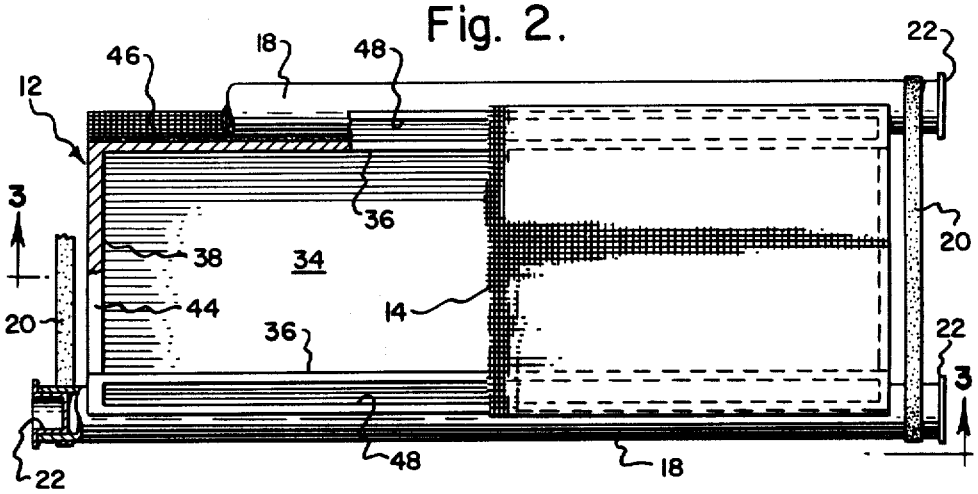
FIGS. 2–6 comprise plan, elevation and end views of a first embodiment of a novel box-like frame having coated abrasive material attached thereto to illustrate a basic component of the inventive hand cabbing apparatus.
Figure 3:
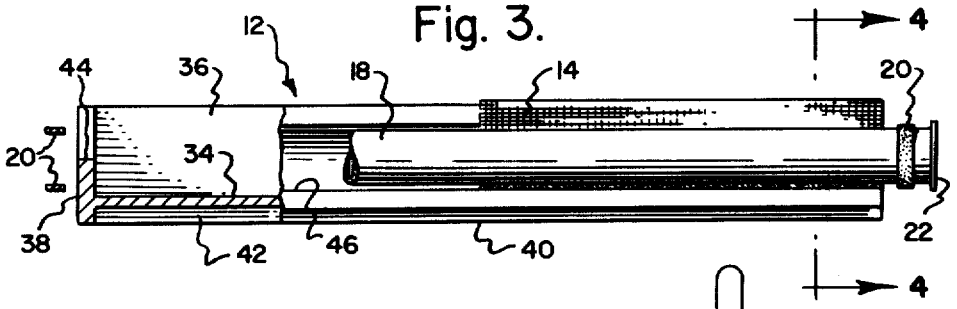

FIG. 1 illustrates, in unassembled form, a series of elements which together form a kit for use in hand cabbing of gemstones. The kit, generally indicated by the numeral 10, is comprised of a base frame or box frame 12, a selection of coated abrasive material 14, a supply of polishing cloths 16, a pair of side rails 18 for attaching the abrasive material 14 and/or polishing cloths 16 to the base frame 12, a supply of elastic bands 20 for holding the side rails 18 in place on the box frame 12, a series of end caps 22 which fit into the ends of side rails 18 for retaining the elastic members 20, a shaping stone 24 formed of bonded abrasive material, a file board 26 having a selection of abrasive grains on opposite sides thereof, differently shaped dop sticks 27 and 28, a pair of preform stones 29, a supply of dop tape 30 which may be trimmed to size to fit either dop stick 27 or dop stick 28 and used to adhere one of the preform stones 29 thereto, a supply of pre-polish material 31 and polish material 31' which are used in connection with polishing cloths 16, and a set of instructions 32 for use by neophites and professionals in utilizing the invention.

FIGS. 2–6 illustrate in assembled form various elements of the kit 10, namely, box frame 12 which is preferably a unitary, molded, plastic material; abrasive material 14 which is preferably formed of a reticulated, mesh screen-like material having abrasive grain such as silicone carbide and the like adhered to both sides thereof; side rails 18 which may be hollow, extruded plastic tubes or wooden dowels and the like, elastic bands 20 for holding the abrasive material 14 to the box frame 12; and end caps 22 for retaining the elastic bands 20 in assembled position.

As can be seen in FIG. 1 and FIGS. 2–6, box frame 12 is comprised of a base 34, a pair of elongated, upstanding side walls 36 and a pair of end walls 38 to provide a generally rectangular box-like member having a hollow interior portion for collecting bits of stone and abrasive material during a grinding operation. Base 34 is particularly shaped to include a bottom or exterior surface 40 containing a series of elongated longitudinally extending ribs 42 such that, in profile or transverse section, the bottom 40 provides a convex working surface, the use of which will be subsequently described. End walls 38 are shaped to include curved surfaces 44 which are recessed slightly below the upstanding side wall 36 for a purpose to be hereinafter described. Side walls 36 are provided with indentations or recesses 46 which are shaped to conform to side walls 18. In addition, side rails 36 are preferably provided along their upper edge with hollow portions 48 for a purpose to be subsequently described.

Figure 4:
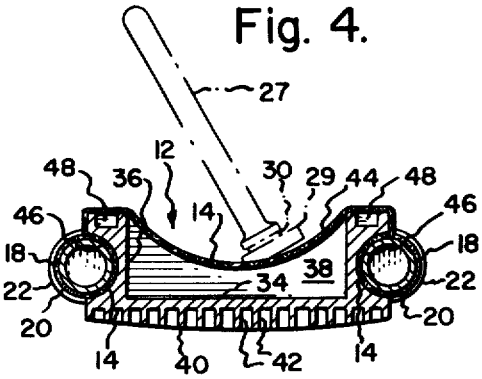

As is best shown in FIGS. 2–6, a sheet of abrasive material 14 (first coarse, then medium and then fine) is positioned across the side walls 36 and located within the pair of recesses 46 and held therein by side rails 18 which, in turn, are secured within the recesses 46 by use of a pair of elastic members 20. As is best shown in FIG. 4, the abrasive material 14 is positioned to extend downwardly into the hollow portion of frame 12, below the uppermost portion of side walls 36, to substantially follow the curved surface 44 of end wall 38. In this configuration, a preform stone 29, which is attached to dop stick 27 by dop tape 30, can be moved back and forth to slowly grind or shape a portion of the stone 29. Ideally, with the dop stick 27 held vertically, reciprocating movement along the longitudinal axis of the frame 12 will cause opposite edges of the stone 29 to be shaped simultaneously without any grinding action being performed upon the lowermost surface of the stone. By utilizing such a reciprocating, longitudinal stroke, the stone 29 may be shaped into a smooth dome, either circular, or oval, etc.

Figure 5:
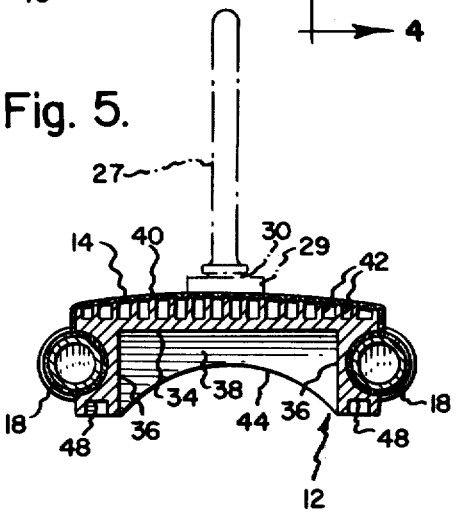
Figure 6:
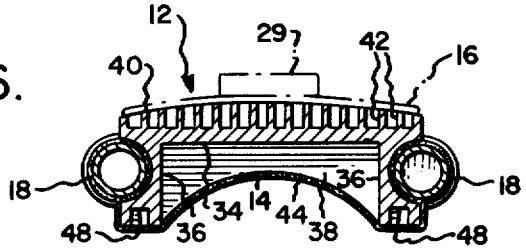

As is shown in FIG. 5, the convex bottom or exterior surface 40 is useful in that the abrasive material 14 may be held in place thereon by the side rails 18 and, with a reciprocating motion of the dop stick 27, a flat surface may be ground on the stone 29. In this regard, the slight convex shape of surface 40 allows for easier grinding or sanding of a flat or nearly flat surface; unless you have an extremely flat surface in which the abrasive grit is embedded, a person would only be able to grind or sand the edges and not the middle. FIG. 6 illustrates that the bottom surface 40 is also useful during pre-polishing and final polishing of the stone 29 by substituting a piece of polishing cloth 16 in place of the abrasive material 14.

In view of the foregoing description of the first embodiment of the invention, it is apparent that the frame 12 is useful in an upright position, as is shown in FIG. 4, and in a reversed position as is shown in FIGS. 5 and 6.

Figures 7, 8, 9, 10:
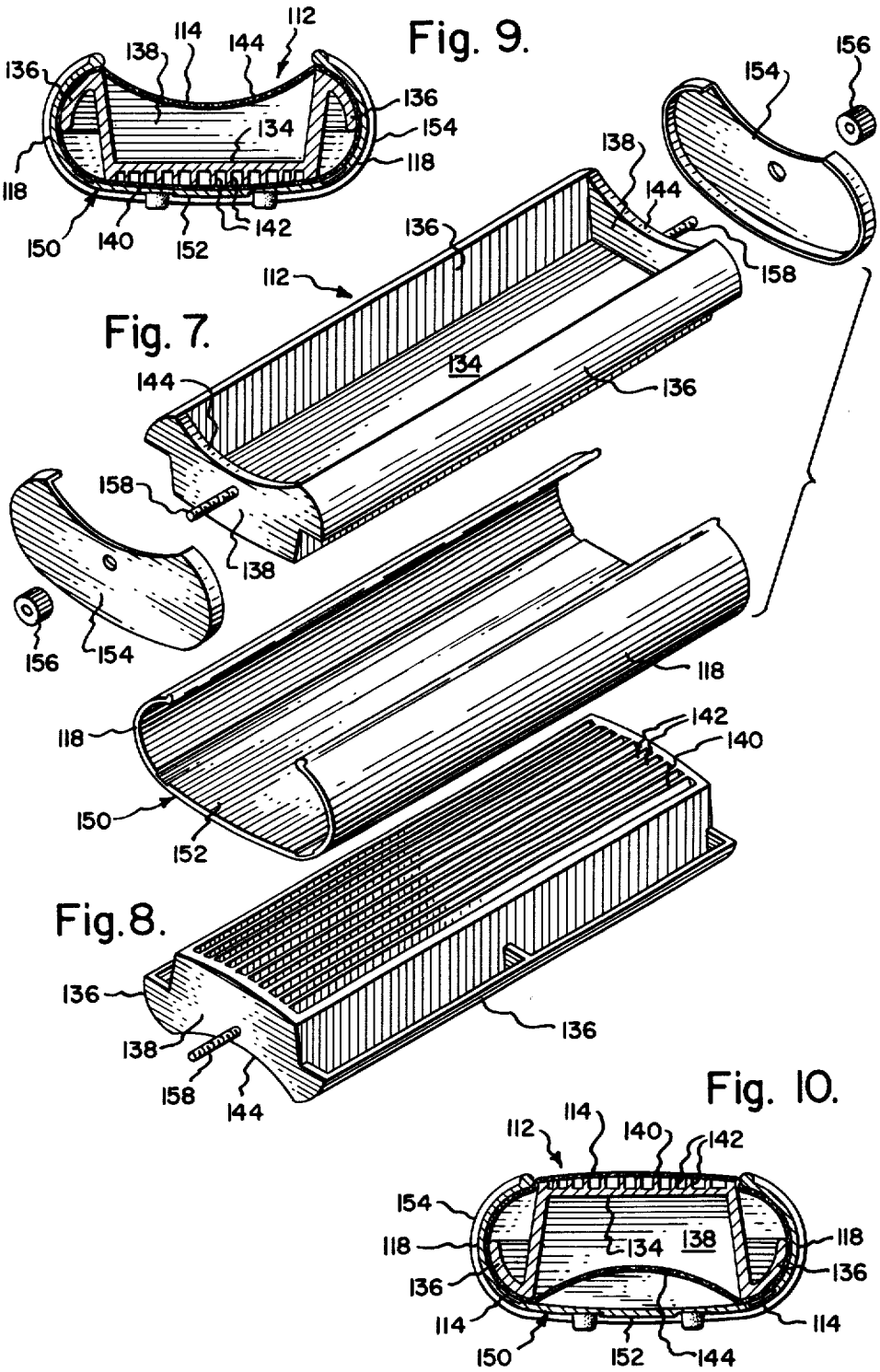
FIGS. 7–10 are perspective views illustrating a second embodiment of the invention.

FIGS. 7–10 illustrate a second embodiment of apparatus which is useful in connection with the present invention. A box frame 112 includes a base 134, longitudinally extending upstanding side walls 136, and spaced end walls 138 each of which is provided with an upper curved surface 144. A sheet of coated abrasive material 114 is placed about the frame 112 and held in place by a sleeve member 150 which includes a pair of C-shaped side rails 118 connected by a central bight portion 152. The side rails 118 are shaped to conform to the exterior surface of the side walls 136 to securely hold the abrasive material 114 in proper operating position with the upper working surface of the abrasive material 114 being curved as is shown in FIG. 9. A pair of end members 154 are provided for holding the sleeve member 150 in position upon the frame 112 through the use of internally threaded nuts 156 and threaded studs 158. Frame 112 has a bottom or exterior surface 140 preferably formed to include a plurality of longitudinally extending ribs 142 which define a curved surface in profile or transverse section. A comparison of FIGS. 9 and 10 will show that sleeve member 150 is reversible such that an upper curved surface of abrasive material 114 is exposed (FIG. 9) or a portion of abrasive material 114 can be exposed in connection with the curved bottom surface 140 (FIG. 10). It should also be noted that the sheet of abrasive material 114 is in the form of an abrasive belt such that the abrasive material 114 can be sequentially positioned about the frame 112 in order to efficiently use the total abrasive surface thereof.

Figure 11:
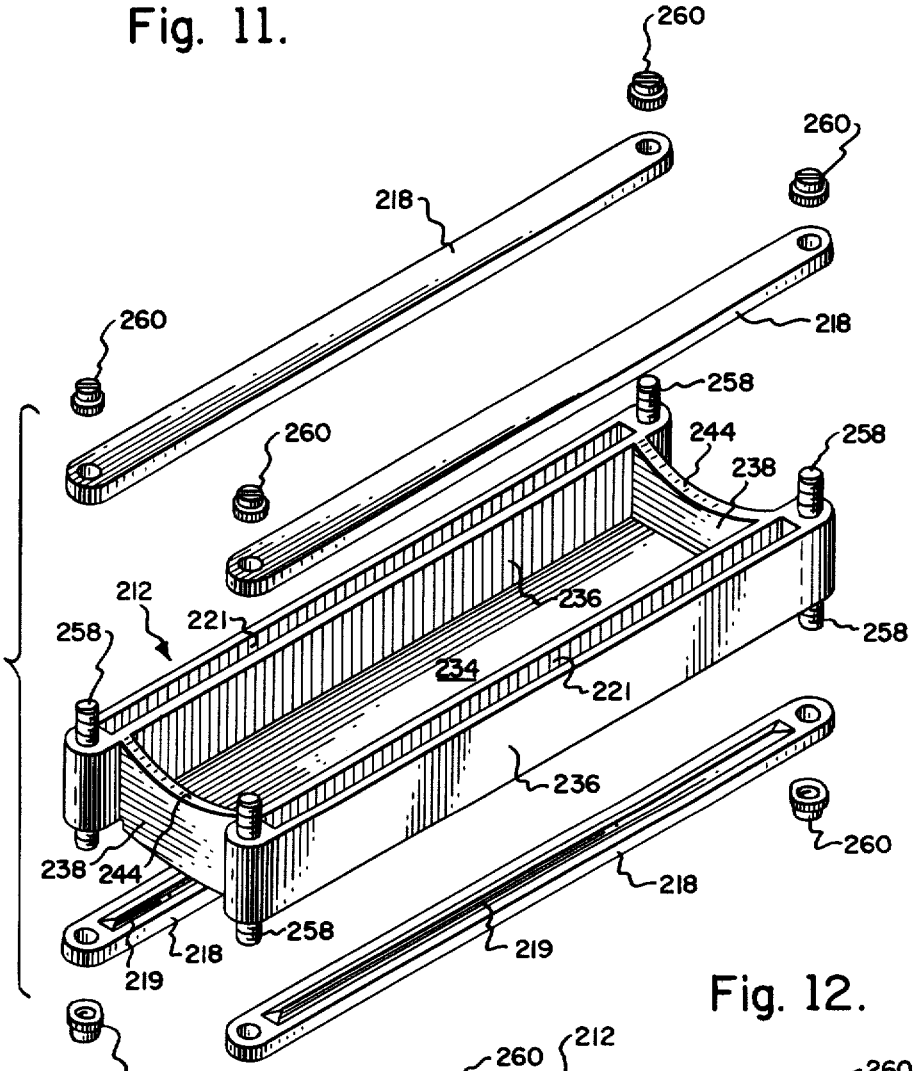
FIGS. 11 and 12 illustrate a third embodiment of the invention.
Figure 12:
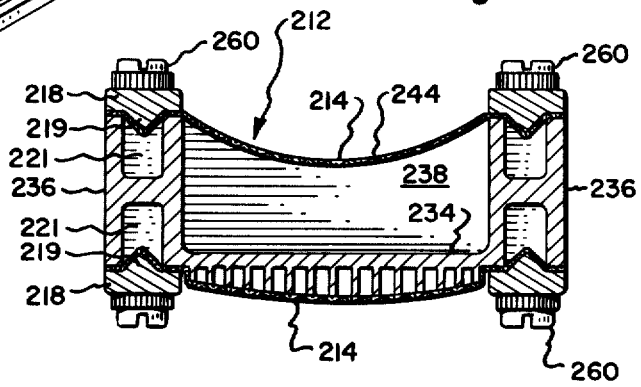

FIGS. 11 and 12 illustrate a third embodiment of apparatus useful with the present invention. In this embodiment, a box frame 212 includes a base 234, a pair of upstanding side walls 236, and a pair of end walls 238 each of which is provided with a curved upper surface 244. A series of side rails 218 are provided to cooperate with side walls 236 for holding coated abrasive material 214 (or polishing cloths 16) in position upon frame 212. The side rails 218 are preferably provided with V-shaped ribs 219 which extend into hollow portions 221 of the side walls 236 for securely holding the abrasive material 214 in position. A series of screw members or threaded studs 158 are located within extensions of the side walls 236 and cooperate with a plurality of cap screws 260 for securely fastening the side rails 236 and abrasive material 214 in operative position.

Figure 13:
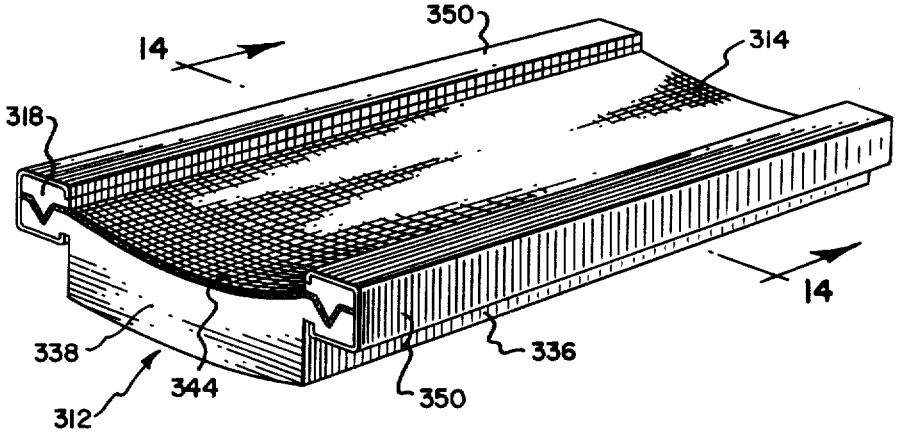
FIGS. 13–15 illustrate a fourth embodiment of the invention.
Figure 14:
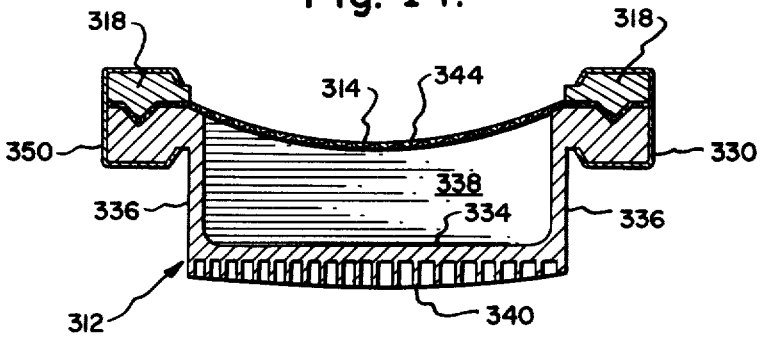
Figure 15:
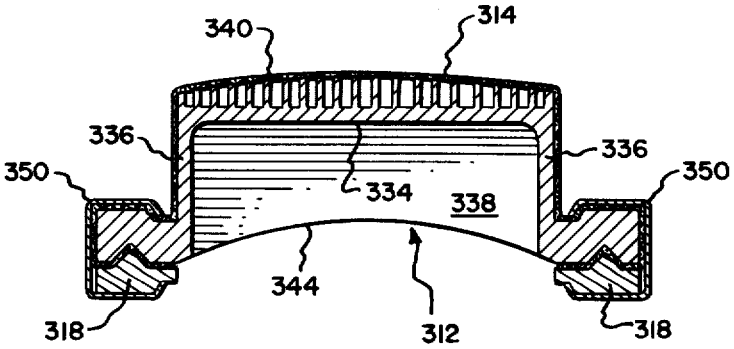

FIGS. 13–15 illustrate a fourth embodiment of appartus for use with the present invention. A box frame 312 includes a base 334, a pair of spaced side walls 336 and a pair of end walls 338 each of which is provided with a curved upper surface 344. A pair of side rails 318 and a pair of C-shaped sleeves 350 cooperate to hold abrasive material 314 in operative position either across the hollow portion of frame 312 (FIG. 14) or across the curved bottom or exterior surface 340 (FIG. 15).

Figure 16:
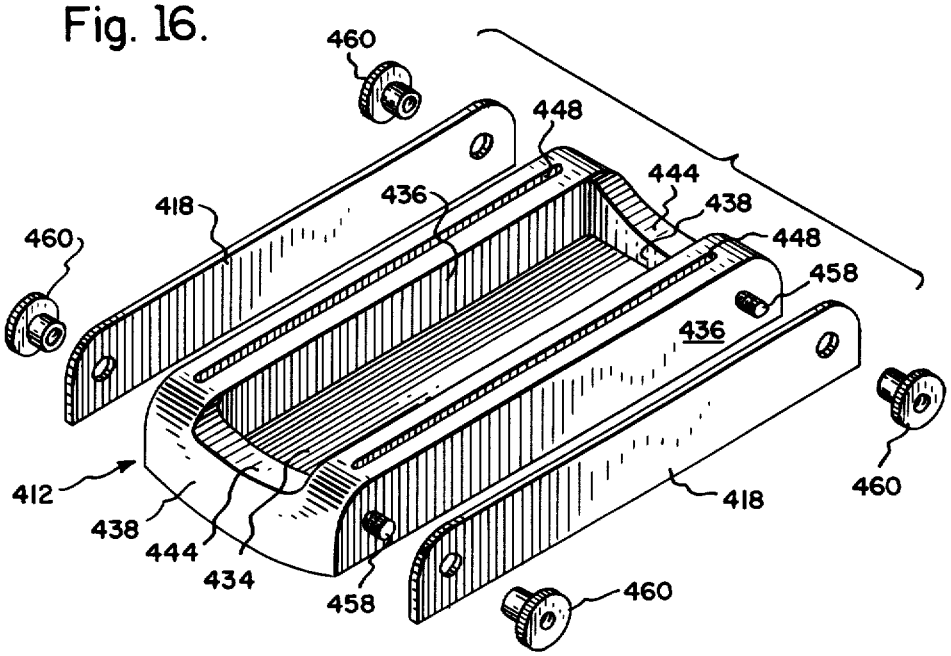
FIGS. 16 and 17 illustrate a fifth embodiment of the invention.
Figure 17:
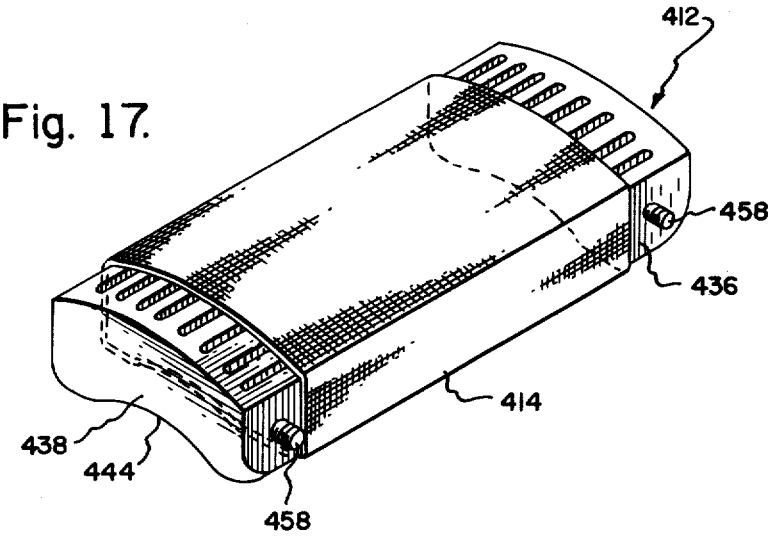

FIGS. 16 and 17 illustrate a fifth embodiment of apparatus for use with the present invention. A box frame 412 is preferably integrally molded from plastic material and the like to provide a base 434, a pair of spaced upstanding side walls 436 and a pair of end walls 438 each of which is provided with a curved upper surface 444. A pair of flat side rails 418 cooperate with threaded studs 458 and nuts 460 to securely fasten abrasive material 414 in operative position about frame 412. Preferably, the sheet of abrasive material 414 is in the form of an endless belt so that full utilization of the working surface thereof can be made. It should be noted that the upper surface of side wall 436 are provided with hollow portions 448 for use in a manner which will be more particularly described in connection with the operation of the various embodiments.

USE OF THE INVENTION

The process of forming gemstones requires grinding and sanding a stone, such as preform stone 29, from a rough shape with a rough surface to a delicate, precise shape with a high polish and lustre. In the process, portions of the stone are removed in the form of very fine, almost invisible, dust. Inhaling the dust or getting it into the pores of skin can be irritating. Thus, the abrasive material, shaping stone, file board and preform stones should always be used under wet conditions and are designed to work best in this manner.

First, a coarse screen abrasive 14 is assembled about a frame 12, 112, 212, 312 or 412 and secured thereto by the side rails 18, etc., as described above, according to the respective embodiment of the invention.

Second, a dop stick 27 or 28 that best fits a particular preform stone 29 is chosen. The dop stick is then adhered to the preform stone 29 by using dop tape 30.

Third, the shaping stone 24 is used to break the top edge of the stone 29 and to quickly round-off excess side material. Using the shaping stone 24 greatly reduces the time spent in initial gemstone shaping. The shaping stone 24 is used "wet" as in all of the grinding and sanding operations. The stone 24 and preform stone 29 should be thoroughly soaked in water prior to and during use. The bottom or exterior surface 40, etc., may be used as a convenient place to rest the shaping stone 24 or it can be placed on some folded paper towels or any convenient surface that would not be marred by the wet stone. Assuming that the desired final shape is to be a full dome top surface, the sharp upper edge of the stone 29 is rounded off along with some of the excess side material by the use of relatively short back and forth strokes of the stone 29 against the shaping stone 24. The upper edge is rounded off on the shaping stone 24 to prevent the preform stone 29 from digging or catching in the coarse abrasive material 14 which, as previously pointed out, is preferably an abrasive coated screen material. This material is available from The Carborundum Company, Niagara Falls, New York under the trademark Sandscreen.

Fourth, after the approximately final shape is achieved through use of the shaping stone 24, final shaping is done on the coarse abrasive material 14. Initial use of that portion of abrasive screen material overlying side walls 36 or 436 will avoid inadvertent cutting of the screen by sharp edges on the preform stone 29; hollow portions 48 and 448 will collect dust and grit. There are many ways to "stroke" the gemstone 29 to achieve its final shape. Following is one method. Align the long axis of the stone 29 with the long axis of the frame 12, etc., and move the stone 29 longitudinally of the frame 12, rotating the stone 29 ninety degrees after every 15 to 30 strokes. This will gradually form the desired dome top surface. The sides and ends of the preform stone 29 will gradually become rounded and the original top flat oval portion will gradually shrink. By keeping the top flat oval centered, until it finally shrinks away, you will end up with a fully domed top shape. When the preform stone 29 has been domed, the next step is to sand out the scratches put on the surface during shaping. The coarse abrasive material 14 is removed and the frame 12, side rails 18, etc., should be cleaned of all dust and grit.

Fifth, install a "medium grit" abrasive material 14 to the frame 12, 112, etc., and keeping the stone 29 and abrasive material 14 "wet", use long sweeping strokes and circular or oval strokes to remove all deep scratches in the surface of the stone 29. Then, replace the "medium grit" abrasive material 14 with "fine grit" abrasive material 14 and proceed as before until the preform stone is really smooth.

Sixth, the smooth stone 29 is then polished. Polishing cloths 16 are, sequentially, used with the pre-polish and polish material 31 and 31'. The polish materials are in the form of powder which is to be mixed with a small amount of water to obtain a cream-like consistency. Polishing is accomplished by the use of short, very rapid strokes. It is not necessary to keep the polishing compound very damp during final polishing. In fact, the final shine will appear when the polishing compound is almost dry. There is little danger of noxious dusts at this time as virtually no gemstone material is being removed. The final polish achieved will rival that achieved on the most expensive cabochonning machines available and the process is performed manually in not much more time.

Lastly, care should be taken in removing the gemstone from the dop stick. The stone should be removed by using a sharp, thin knife; "popping off" soft stones by using thumb pressure may cause breaking of the stone.

If desired, the gemstone may be fixed to various types of jewelery mountings which are available from lapidary companies, dealers, retail outlets, hobby shops, etc. The most common mountings are glue-on pads, prong or claw mounts, and bezel mounts which may be solid, either full or partial, or various lace and prong designs.

While various embodiments of the invention have been specifically illustrated and described herein, it is to be understood that minor variations may be made in the disclosed kit and frames 12, 112, etc., without departing from the spirit and scope of the invention, as defined by the appended claims.

I claim:

1. Cabbing apparatus comprising:

an elongated frame providing a pair of longudinal side walls and a bottom wall therebetween, said bottom wall having a convex exterior surface interrupted by grit collection groove and an inner surface, said grooves extending longitudinally of the frame, an abrasive sheet, retaining means opposing the outside of said side walls for holding said abrasive sheet in working position gripped between the retaining means and the side walls and spaced above the inner surface of the bottom wall or engaging the convex exterior surface thereof, said retaining means including a pair of longitudinal side rails holding side edge portions of said sheet against said side walls and a pair of elastic bands stretched around said side rails near the ends thereof to hold the side rails in position, and end walls on the frame connecting the side walls and having a curved, concave upper wall to define the concavity for dishing the abrasive sheet downwardly when it is held spaced above the inner surface of the bottom wall.

2. Cabbing apparatus according to claim 1 in which said side walls each have a transversely rounded groove extending its full length, said retaining means comprising a pair of round side rails mating with said longitudinal grooves and projecting endwise beyond the ends of the frame, said elastic bands being stretched around the projecting end portions of the side rails to urge them toward said longitudinal grooves.

* * * * *